US009207053B2

(12) United States Patent
Ell et al.

(10) Patent No.: US 9,207,053 B2
(45) Date of Patent: Dec. 8, 2015

(54) HARMONIC SHUTTERED SEEKER

(71) Applicant: Rosemount Aerospace, Inc., Burnsville, MN (US)

(72) Inventors: Todd Ell, Savage, MN (US); Robert Rutkiewicz, Edina, MN (US)

(73) Assignee: ROSEMOUNT AEROSPACE INC., Burnsville, MN (US)

( * ) Notice: Subject to any disclaimer, the term of this patent is extended or adjusted under 35 U.S.C. 154(b) by 38 days.

(21) Appl. No.: 13/923,986

(22) Filed: Jun. 21, 2013

(65) Prior Publication Data

US 2014/0374533 A1 Dec. 25, 2014

(51) Int. Cl.

| | |
|---|---|
| ***F41G 7/22*** | (2006.01) |
| ***F42B 15/01*** | (2006.01) |
| ***F41G 9/00*** | (2006.01) |
| *F41G 7/00* | (2006.01) |
| *F42B 15/00* | (2006.01) |

(52) U.S. Cl.

CPC ..... *F42B 15/01* (2013.01); *F41G 7/226* (2013.01); *F41G 7/2293* (2013.01); *F41G 9/00* (2013.01)

(58) Field of Classification Search

CPC ..... G01R 23/02; F42B 15/01; F41G 9/00; F41G 7/20; F41G 7/22; F41G 7/226; F41G 7/2273; F41G 7/2293

USPC ..... 244/3.1–3.19; 382/100, 103; 324/323, 324/332, 334, 338; 340/425.5, 435; 396/439, 452, 453, 455; 702/127, 142, 702/143, 144

See application file for complete search history.

(56) References Cited

U.S. PATENT DOCUMENTS

| | | | | | |
|---|---|---|---|---|---|
| 3,743,216 | A | * | 7/1973 | Salonimer | 244/3.16 |
| 4,091,412 | A | * | 5/1978 | Salonimer | 244/3.16 |
| 4,112,294 | A | * | 9/1978 | Pressiat | 244/3.16 |
| 4,131,248 | A | * | 12/1978 | Berglund | 244/3.16 |
| 4,234,145 | A | * | 11/1980 | Leiboff | 244/3.16 |
| 4,314,761 | A | * | 2/1982 | Reymond et al. | 244/3.16 |
| 4,386,848 | A | * | 6/1983 | Clendenin et al. | 244/3.16 |
| 4,615,496 | A | * | 10/1986 | Pinson | 244/3.16 |
| 4,732,349 | A | * | 3/1988 | Maurer | 244/3.13 |
| 5,121,148 | A | * | 6/1992 | Windeler et al. | 396/455 |
| 5,129,309 | A | * | 7/1992 | Lecuyer | 244/3.11 |

(Continued)

FOREIGN PATENT DOCUMENTS

FR 2912573 A1 8/2008

OTHER PUBLICATIONS

S. Park, et al., "Super-Resolution Image Reconstruction: A Technical Overview," Signal Processing Magazine, IEEE, vol. 20; No. 3; pp. 21, 36, May 2003.

(Continued)

*Primary Examiner* — Bernarr Gregory

(74) *Attorney, Agent, or Firm* — Cantor Colburn LLP

(57) ABSTRACT

A dual-mode, semi-active, laser-based and passive image-based seeker for projectiles, missiles, and other ordnance that persecute targets by detecting and tracking energy scattered from targets. The disclosed embodiments use a single digital imager having a single focal plane array sensor to sense data in both the image-based and laser-based modes of operation. A shuttering technique allows the relatively low frame-rate of the digital imager to detect, decode and localize in the imager's field-of-view a known pulse repetition frequency (PRF) from a known designator in the presence of ambient light and other confusing target designators, each having a different PRF.

20 Claims, 7 Drawing Sheets

(56) References Cited

U.S. PATENT DOCUMENTS

| | | | | |
|---|---|---|---|---|
| 5,129,595 | A * | 7/1992 | Thiede et al. | 244/3.16 |
| 5,138,162 | A * | 8/1992 | Hacskaylo | 244/3.16 |
| 5,323,987 | A * | 6/1994 | Pinson | 244/3.16 |
| 5,583,505 | A | 12/1996 | Andersen et al. | |
| 5,826,216 | A * | 10/1998 | Lyons et al. | 702/143 |
| 6,003,810 | A * | 12/1999 | Roze des Ordons et al. | 244/3.16 |
| 6,111,241 | A | 8/2000 | English et al. | |
| 6,123,288 | A * | 9/2000 | Kenyon | 244/3.16 |
| 6,225,891 | B1 * | 5/2001 | Lyons et al. | 340/435 |
| 6,987,256 | B2 | 1/2006 | English et al. | |
| 7,382,135 | B2 * | 6/2008 | Li et al. | 324/338 |
| 7,858,939 | B2 | 12/2010 | Tener et al. | |
| 8,164,037 | B2 | 4/2012 | Jenkins et al. | |
| 8,354,626 | B2 * | 1/2013 | Eckhardt | 244/3.16 |
| 8,581,771 | B2 * | 11/2013 | Bradley | 244/3.1 |
| 2012/0211665 | A1 | 8/2012 | Cloud et al. | |

OTHER PUBLICATIONS

European Search Report dated Feb. 12, 2015 for European Application No. 14173511.8. (7 pgs).

* cited by examiner

| | ACTUAL POSITIVE (p) | ACTUAL NEGATIVE (n) | TOTAL |
|---|---|---|---|
| PREDICTED POSITIVE (p´) | TRUE POSITIVE (TP) | FALSE POSITIVE (FP) | P´ |
| PREDICTED NEGATIVE (n´) | FALSE NEGATIVE (FN) | TRUE NEGATIVE (TN) | N´ |
| TOTAL | P | N | |

HARMONIC SHUTTERED SEEKER

REFERENCE TO CO-PENDING APPLICATIONS FOR PATENT

The present Application for Patent is related to the following co-pending U.S. Patent Applications:

"LASER-AIDED PASSIVE SEEKER" by Todd A. Ell, having application Ser. No. 13/923,923, filed Jun. 21, 2013, assigned to the assignee hereof, and expressly incorporated by reference herein; and "SEEKER HAVING SCANNING-SNAPSHOT FPA" by Todd A. Ell, having application Ser. No. 13/924,028, filed Jun. 21, 2013, assigned to the assignee hereof, and expressly incorporated by reference herein.

FIELD OF DISCLOSURE

The subject matter disclosed herein relates in general to guidance subsystems for projectiles, missiles and other ordnance. More specifically, the subject disclosure relates to the target sensing components of guidance subsystems used to allow ordnance to persecute targets by detecting and tracking energy scattered from targets.

BACKGROUND

Seeker guided ordnances are weapons that can be launched or dropped some distance away from a target, then guided to the target, thus saving the delivery vehicle from having to travel into enemy defenses. Seekers make measurements for target detection and tracking by sensing various forms of energy (e.g., sound, radio frequency, infrared, or visible energy that targets emit or reflect). Seeker systems that detect and process one type of energy are known generally as single-mode seekers, and seeker systems that detect and process multiples types of energy (e.g., radar combined with thermal) are generally known as multi-mode seekers.

Seeker homing techniques can be classified in three general groups: active, semi-active, and passive. In active seekers, a target is illuminated and tracked by equipment on board the ordnance itself. A semi-active seeker is one that selects and chases a target by following energy from an external source, separate from the ordnance, reflecting from the target. This illuminating source can be ground-based, ship-borne, or airborne. Semi-active and active seekers require the target to be continuously illuminated until target impact. Passive seekers use external, uncontrolled energy sources (e.g., solar light, or target emitted heat or noise). Passive seekers have the advantage of not giving the target warning that it is being pursued, but they are more difficult to construct with reliable performance. Because the semi-active seekers involve a separate external source, this source can also be used to "designate" the correct target. The ordnance is said to then "acquire" and "track" the designated target. Hence both active and passive seekers require some other means to acquire the correct target.

In semi-active laser (SAL) seeker guidance systems, an operator points a laser designator at the target, and the laser radiation bounces off the target and is scattered in multiple directions (this is known as "painting the target" or "laser painting"). The ordnance is launched or dropped somewhere near the target. When the ordnance is close enough for some of the reflected laser energy from the target to reach the ordnance's field of view (FOV), a seeker system of the ordnance detects the laser energy, determines that the detected laser energy has a predetermined pulse repetition frequency (PRF) from a designator assigned to control the particular seeker system, determines the direction from which the energy is being reflected, and uses the directional information (and other data) to adjust the ordnance trajectory toward the source of the reflected energy. While the ordnance is in the area of the target, and the laser is kept aimed at the target, the ordnance should be guided accurately to the target.

Multi-mode/multi-homing seekers generally have the potential to increase the precision and accuracy of the seeker system but often at the expense of increased cost and complexity (more parts and processing resources), reduced reliability (more parts means more chances for failure or malfunction), and longer target acquisition times (complex processing can take longer to execute). For example, combining the functionality of a laser-based seeker with an image-based seeker could be done by simple, physical integration of the two technologies; however, this would incur the cost of both a focal plane array (FPA) and a single cell photo diode with its associated diode electronics to shutter the FPA. Also, implementing passive image-based seekers can be expensive and difficult because they rely on complicated and resource intensive automatic target tracking algorithms to distinguish an image of the target from background clutter under ambient lighting.

Because seeker systems tend to be high-performance, single-use items, there is continued demand to reduce the complexity and cost of seeker systems, particularly multi-mode/multi-homing seeker systems, while maintaining or improving the seeker's overall performance.

SUMMARY

The disclosed embodiments include a method of detecting and decoding pulses having a predetermined PRF, the steps comprising: dividing a pulse interval of the predetermined PRF into a plurality of repeating subintervals; shuttering alternating ones of said plurality of repeating subintervals with an exposure; determining whether two or more received pulses are received in one of said subintervals by said shuttering step; and identifying said one of said subintervals of said pulse interval, thereby detecting and decoding said received pulses of said one of said subintervals as having the predetermined PRF.

The disclosed embodiments further include an imager for detecting and decoding pulses having a predetermined PRF, the imager comprising: means for dividing a pulse interval of the predetermined PRF into a plurality of subintervals; means for shuttering alternating ones of said plurality of subintervals with an exposure; means for determining whether two or more received pulses are received in one of said subintervals; and means for identifying said one of said subintervals within said pulse interval, thereby detecting and decoding said received pulses of said one of said subintervals as having the predetermined PRF.

The disclosed embodiments further include an imager for detecting and decoding image data and laser data having a predetermined PRF, the imager comprising: a focal plane array; and a configuration that controls said focal plane array to decode the image data and the laser; said configuration comprising: dividing a pulse interval of the predetermined PRF into a plurality of subintervals; shuttering alternating ones of said plurality of subintervals with an exposure; determining whether two or more received pulses are received in one of said subintervals; and identifying said one of said subintervals of said pulse interval, thereby detecting and decoding said received pulses of said one of said subintervals as having the predetermined PRF.

The disclosed embodiments further include an imager for detecting and decoding image data and laser data having a predetermined PRF, the imager comprising: a focal plane array; and mean for controlling said focal plane array to decode the image data and the laser data comprising: means for dividing a pulse interval of the predetermined PRF into a plurality of subintervals; means for shuttering alternating ones of said plurality of subintervals with an exposure; means for determining whether received pulses are received in one of said subintervals more than once; and means for identifying said one of said subintervals of said pulse interval.

BRIEF DESCRIPTION OF THE DRAWINGS

The accompanying drawings are presented to aid in the description of embodiments of the invention and are provided solely for illustration of the embodiments and not limitation thereof.

In the accompanying figures and following detailed description of the disclosed embodiments, the various elements illustrated in the figures are provided with three-digit reference numbers. The leftmost digit of each reference number corresponds to the figure in which its element is first illustrated.

DETAILED DESCRIPTION

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

Further, many embodiments are described in terms of sequences of actions to be performed by, for example, elements of a computing device. It will be recognized that various actions described herein can be performed by specific circuits (e.g., application specific integrated circuits (ASICs)), by program instructions being executed by one or more processors, or by a combination of both. Additionally, the sequence of actions described herein can be considered to be embodied entirely within any form of computer readable storage medium having stored therein a corresponding set of computer instructions that upon execution would cause an associated processor to perform the functionality described herein. Thus, the various aspects of the invention may be embodied in a number of different forms, all of which have been contemplated to be within the scope of the claimed subject matter. In addition, for each of the embodiments described herein, the corresponding form of any such embodiments may be described herein as, for example, "logic configured to" perform the described action.

Figure 1:
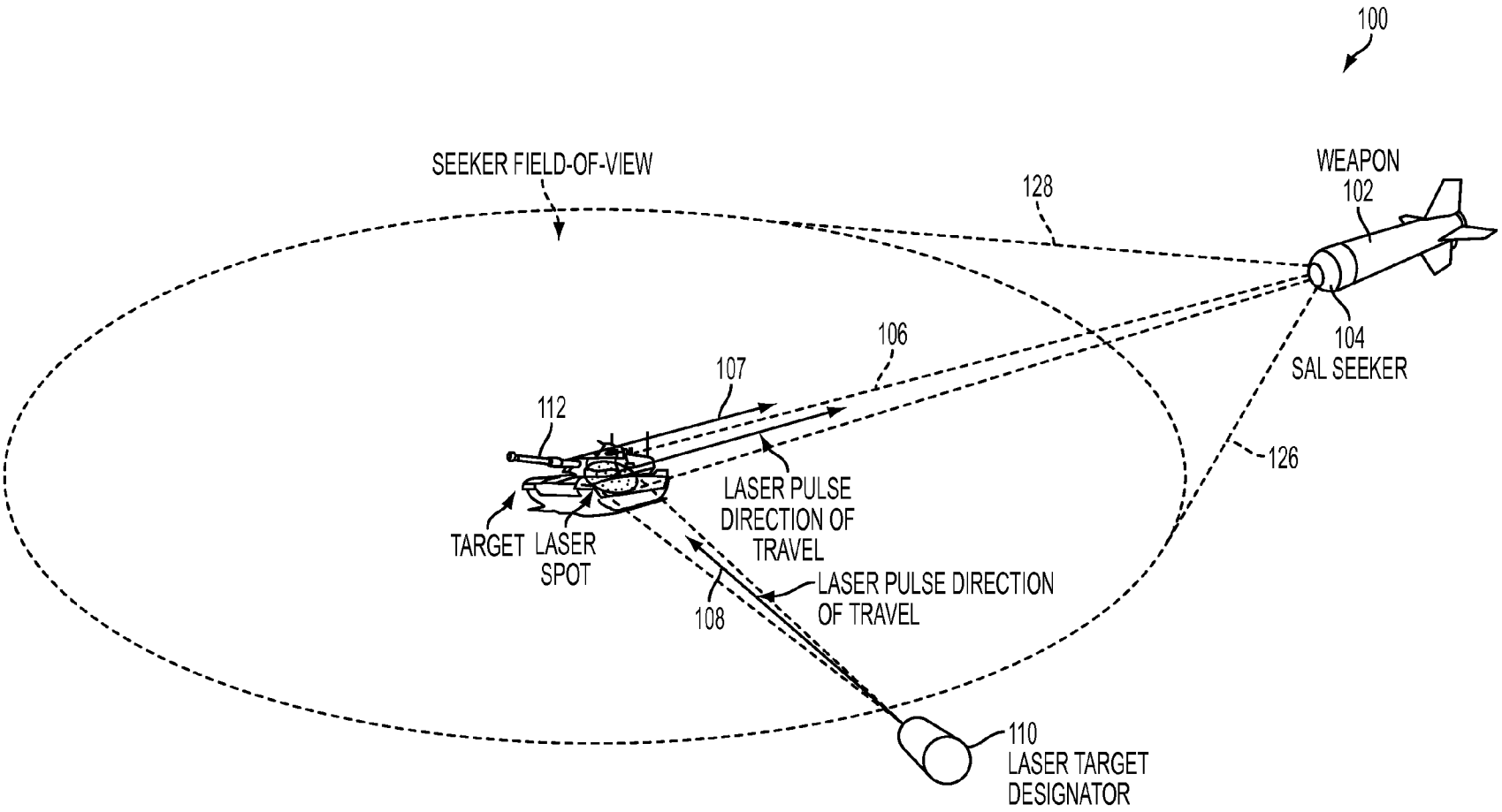
FIG. 1 is a schematic illustration of a precision guided projectile engaging a target.

FIG. 1 is a schematic diagram of a seeker guided ordnance system 100 capable of utilizing the disclosed embodiments. As shown in FIG. 1, a seeker guided ordnance (shown as a projectile 102) may engage a target 112 by using a seeker system 104 of the ordnance/projectile 102 to detect and follow energy 106, 107 that has been reflected from the target 112 into the sensor system's FOV. The sensor system's FOV is generally illustrated in FIG. 1 as the area between directional arrows 126, 128. The reflected energy may be laser energy 106 or some other energy 107 (e.g. ambient light for deriving an image). The seeker system 104 may be equipped with sufficient sensors and other electro-optical components to detect energy in various portions of the electromagnetic spectrum, including the visible, infrared (IR), microwave and millimeter wave (MMW) portions of the spectrum. The seeker system 104 may incorporate one or more sensors that operate in more than one portion of the spectrum. Single-mode implementations of the seeker system 104 utilize only one form of energy to detect, locate and localize the target 112. Multi-mode implementations of the seeker system 104 utilize more than one form of energy to detect, locate and localize the target 112. In the present disclosure, the term "detect," when used in connection with reflected laser energy, generally refers to sensing energy from an unknown target. The term "decode" refers to verifying that a PRF of the detected laser energy matches the pre-determined, expected PRF of the projectile/designator pair. The term "lock" refers to time synchronization of the pulse occurrence with a seeker clock. To "lock-on" signifies that a tracking or target-seeking system is continuously and automatically tracking a target in one or more coordinates (e.g., pulse time, range, bearing, elevation). The term "localize" refers to resolving where the detected, decoded laser energy occurs in the sensor system's FOV (126, 128).

Continuing with FIG. 1, the target 112 is illustrated as a military tank but may be virtually any object capable of reflecting energy, including for example another type of land vehicle, a boat or a building. For laser-based implementations, the target 112 may be illuminated with laser energy 108 from a laser designator 110. The laser designator 110 may be located on the ground, as shown in FIG. 1, or may be located in a vehicle, ship, boat, or aircraft. For some applications (not shown), the laser designator 110 could be located on the projectile itself. The designator 110 transmits laser energy 108 having a certain power level, typically measured in millijoules per pulse, and a certain PRF, typically measured in hertz. Each designator 110 and projectile 102 set is provided with the same, unique PRF code. For laser-based implementations, the seeker system 104 must identify from among the various types of detected energy reflected laser energy 106 having the unique PRF assigned to the projectile 102 and designator 110 pair. Laser-based seeker systems are generally referred to as "(semi-)active" imaging seekers because they require that a target is actively illuminated with laser energy in order to detect, decode and localize the target. Passive image-based seeker systems are known as "passive" because they track targets using uncontrolled reflected energy from the target (e.g., solar energy) and require relatively complicated and potentially costly automatic target tracking algorithms and processing resources to distinguish an image of the target from background clutter. Thus, the seeker system 104, which may be equipped with multi-mode, multi-homing (active and/or passive) functionality, uses information (e.g., PRF, an angle of reflection, images) derived from the reflected energy 106, 107, along with other information (e.g., GPS coordinates), to identify the location of the target 112 and steer the projectile 102 to the target 112.

Important performance parameters for seeker systems include how quickly, reliably and efficiently the seeker system detects, decodes and localizes the energy it receives in its FOV. As previously described, one way to improve the detection, decoding and localization of a seeker system is to provide the seeker system with the capability of processing more than one type of energy (e.g., radar, laser and/or imaging) to identify a target. A seeker system capable of processing more than one type of energy for target acquisition is known generally as a multi-mode seeker. A seeker system capable of operating in more than one type of homing mode (active/semi-active/passive) is known as a multi-homing seeker. Multi-mode/multi-homing seeker systems have the advantage of being robust and reliable and may be operated over a range of environments and conditions. However, combining more than one target acquisition mode into a single seeker typically adds redundancy. For example, conventional multi-mode implementations require two disparate sensor systems, with each sensor system having its own antenna and/or lens, along with separate processing paths. This increases the number of parts, thereby increasing cost. Cost control is critical for single-use weapons that may sit on a shelf for 10 years then be used one time. More parts also increase the probability of a part malfunctioning or not performing the way it is expected to perform.

Accordingly, the present disclosure recognizes that multi-tasking components/functionality of a multi-mode/multi-homing seeker so one component (e.g., sensor, lens) can operate in both modes has the potential to control costs and improve reliability and performance. For example, the FPA of a seeker system converts reflected energy in the seeker's FOV into electrical signals that can then be read out, processed and/or stored. Using only a single, conventional FPA as the primary optical component for more than one mode/homing technique would potentially reduce the complexity and cost, and improve the reliability of multi-mode/multi-homing seeker systems.

The design challenges of using only the FPA output to detect, decode and localize the laser spot in a seeker's FOV include challenges associated with the digital imager, the exposure gap, avoiding ambient confusion and avoiding designator confusion. Conventional digital imagers, as previously described, are inherently sampled data, integrate-and-dump systems. The imager accumulates or integrates all of the received energy across the entire expose time, effectively low-pass filtering the signals, blending multiple pulses arriving at different times into a single image. Given that two or more designators can be active in the same target area, the sample time resolution of conventional digital imagers is typically insufficient to reconstruct all the incoming pulses. This typically requires expensive and complicated systems to compensate for a higher likelihood of not detecting, decoding or localizing a received pulse when the received pulse actually matches the seeker's pre-loaded PRF. Using an integration process precludes the use of a camera having a relatively long exposure time because a long exposure time would increase the likelihood of capturing several pulses when the imager opens the shutter. Imager exposure gaps, or exposure windows, typically span the pulse repetition interval of the predetermined PRF so cannot distinguish constant light sources from designator pulses. Accordingly, sub-interval exposure windows cannot be made to cover 100% of a pulse interval due to a minimum time to complete a frame, capture and initialize the imager for the next frame. In other words, the dead-time (also known as the "dark time" of the imager) between exposure windows (measured in microseconds) is wider than typical designator pulse widths (measured in 10-100 nanoseconds). Background clutter levels may potentially be reduced by decreasing the exposure time, but this increases the probability that a laser pulses will be missed altogether. Ambient confusion occurs when the imager has difficulty distinguishing between ambient light features and designator energy. Reflected energy is proportional to the angle of reflection of the target, i.e., acute angles between light source and imager yield higher reflected energy, and obtuse angles yield lower reflected energy. Also, solar glint or specular reflection off background clutter is a difficult problem with respect to relative energy. For example, a top-down attack with the sun "over the shoulder" of the weapon, and a ground-based designator with an almost 90 degree reflection angle is the worst geometry for engagement/designation with respect to received laser energy. So a clear day at noon time is the most challenging. Finally, so that multiple designators can operate simultaneously in the same target area, a single FPA design should reliably distinguish its assigned designator from other, "confuser" designators operating simultaneously in the same target area.

Turning now to an overview of the disclosed embodiments, the present disclosure describes a harmonic shuttering methodology that improves the speed, accuracy, reliability and cost-effectiveness of detect, decode and localize functionality of a seeker system. The disclosed harmonic shuttering methodology may be implemented in a multi-mode, multi-homing seeker system. The disclosed harmonic shuttering methodology resolves PRF acquisition times quickly (e.g., within two pulse intervals) and accurately to ensure that pulses are not missed in the dark time of a shutter cycle. In summary, the harmonic shutter methodology determines the pulse interval of the PRF of the projectile/designator pair, divides the pulse interval into an odd number of subintervals (each preferably of equal length), continuously shutters every other interval with an exposure, then looks for a subinterval in which a pulse is detected repeatedly. A pulse that comes through with the PRF of the projectile/designator pair will be seen in the same subinterval every time as the seeker system is continuously shuttered on an odd multiple of the predetermined PRF. The length of the subintervals may be made short enough to distinguish different PRF's from designators operating at PRF's that might in fact be close in frequency to one another. Also, once the methodology has identified that the assigned/predetermined PRF is in a particular subinterval, for example subinterval 10, there should be no pulses identified in the other subintervals. The methodology can then shutter on different subintervals to make sure that a pulse is not identified in the other subintervals, which reconfirms that the right PRF pulse has been detected in subinterval 10.

Figure 2:
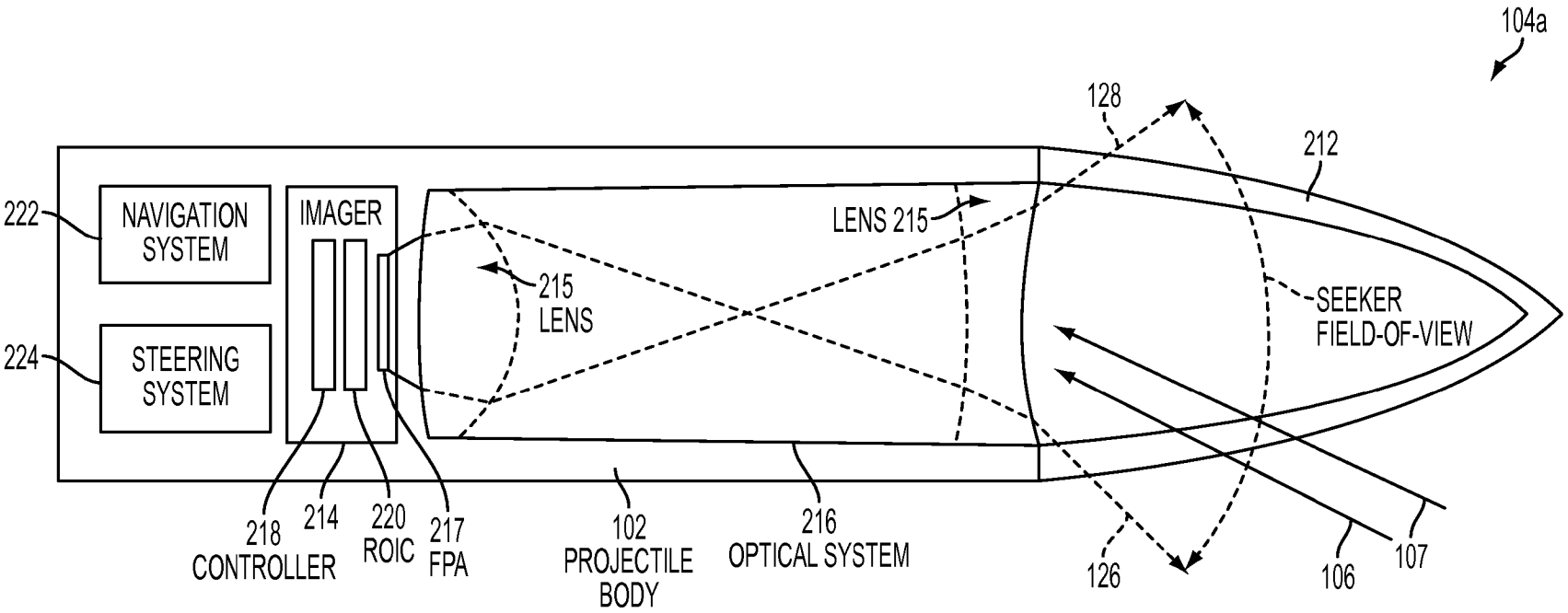
FIG. 2 is a high level block diagram showing additional details of a seeker system of the disclosed embodiments, wherein only an FPA is used as the active sensor to achieve both the active laser-based and the passive image-based modes of operation.

With reference now to the accompanying illustrations, FIG. 2 is a block diagram illustrating a seeker system 104*a* of the disclosed embodiments. Seeker system 104*a* corresponds to the seeker system 104 shown in FIG. 1, but shows additional details of how the seeker system 104 may be modified to provide a single imager 214, which is preferably a short-wave infrared (SWIR) imager or its equivalent, that is capable of capturing both laser and image data through a single FPA of the imager. In accordance with the disclosed embodiments, the single imager 214 includes an FPA 217 that is configured and arranged to be sensitive to the typical wavelengths of laser target designators. As such, imager 214 can detect the laser radiation reflected from a target. The disclosed embodiments provide means for synchronizing the imager's shutter or exposure time with the reflected laser pulse to ensure the laser pulse is captured in the image. In contrast, a conventional imager is not sensitive to laser light and requires a separate sensor to capture laser light and integrate it with an image. The above-described reflected laser energy captured by an imager is referred to herein as "semi-active laser" (SAL) energy, and the captured images containing the laser spot are referred to herein "semi-active images" (SAI). Therefore, the frame rate of the imager 214 may be configured to match the pulse repetition interval (PRI) of the laser designator 110 (shown in FIG. 1) (i.e., the frame rate=1/PRI).

Thus, the seeker system 104*a* of FIG. 2 is capable of providing multi-mode/multi-homing functionality and includes a seeker dome 212, an imager 214, a navigation system 222 and a steering system 224. The seeker dome 212 includes a FOV identified by the area between arrows 126, 128. Reflected laser energy 106 and other energy 107 (e.g., ambient light or image energy) within the FOV 126,128 may be captured by the seeker system 104*a*. The imager 214 includes an optical system 216 having a lens system 215, a readout integrated circuit (ROIC) 220 and control electronics 218. The imager 214 includes a detector that is preferably implemented as the single FPA 217. The imager components (217, 218 and 220), along with the optical components (215, 216), are configured and arranged as described above to focus and capture incoming energy (e.g., reflected laser energy 106 and/or ambient light energy 107). The FPA 217 and ROIC 220 convert incoming laser or ambient light energy 106, 107 to electrical signals that can then be read out and processed and/or stored. The control electronics stage 218 provides overall control for the various operations performed by the FPA 217 and the ROIC 220 in accordance with the disclosed embodiments. The imager 214 generates signals indicative of the energy 106, 107 received within the imager's FOV (126, 128), including signals indicative of the energy's PRF and the direction from which the pulse came. The navigation system 222 and steering system 224 utilize data from the imager 214, along with other data such as GPS, telemetry, etc., to determine and implement the appropriate adjustment to the flight path of the projectile 102 to guide the projectile 102 to the target 112 (shown in FIG. 1). Although illustrated as separate functional elements, it will be understood by persons of ordinary skill in the relevant art that the various electro-optical components shown in FIG. 2 may be arranged in different combinations and implemented as hardware, software, firmware, or a combination thereof without departing from the scope of the disclosed embodiments.

Figure 3:
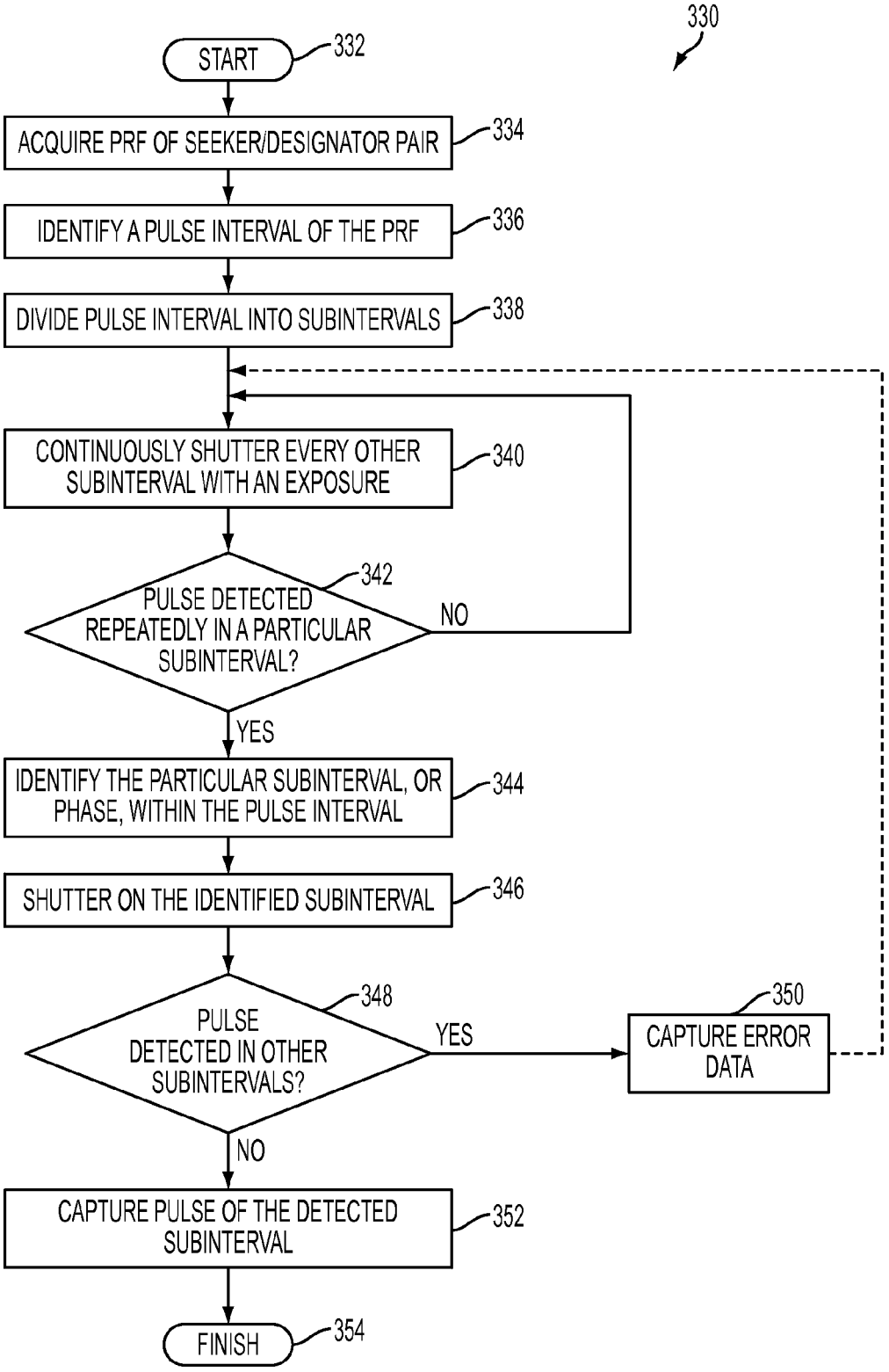
FIG. 3 is a high level flow diagram illustrating a harmonic shuttering methodology of the disclosed embodiments.

FIG. 3 is a high level flow diagram illustrating a harmonic shuttering methodology 330 of the disclosed embodiment. The term "harmonic shuttering" refers to the fact that the methodology captures energy at an odd harmonic multiple of the PRF assigned to a particular seeker/designator pair. The methodology 330 starts at step 332 and finishes at step 354. However, the methodology 330 is cyclical in nature and all or portions of the methodology 330 may be repeated and/or run in parallel as needed to detect and decode a predetermined PRF. As shown in FIG. 3, methodology 330 associates a predetermined PRF with a particular designator. The pulse interval is the elapsed time from the beginning of one pulse to the beginning of the next pulse. Step 336 identifies a pulse interval of the predetermined PRF, and step 338 divides the pulse interval into a preferred odd number of subintervals that are ideally of equal length durations. Step 340 continuously shutters every other subinterval with an exposure. Decision block 342 monitors step 340 and evaluates whether a pulse is repeatedly detected in a particular subinterval. If the result of the inquiry at decision block 342 is no, the methodology 330 continues with step 340 and continuously shutters every other subinterval with an exposure. If the result of the inquiry at decision block 342 is yes, the methodology 332 moves to step 344 and identifies the particular subinterval/phase within the pulse interval. Step 346 then focuses the shuttering activity on the identified subinterval. A PRF lock exists once one and only one subinterval is identified. Decision block 348 and step 350 may be optionally included to ensure that the predetermined PRF has been accurately identified in a particular subinterval by confirming that the predetermined PRF is not seen in the other subintervals. Accordingly, decision block 348 evaluates whether a pulse is detected in other subintervals. If the result of the inquiry at decision block 348 is yes, the methodology 330 captures error data at step 350 and returns to step 340 and continuously shutters every other subinterval with an exposure. If the result of the inquiry at decision block 348 is no, the methodology 332 moves to step 352 and captures the pulse of the identified subinterval. The methodology 330 finishes at step 354.

Figure 4:
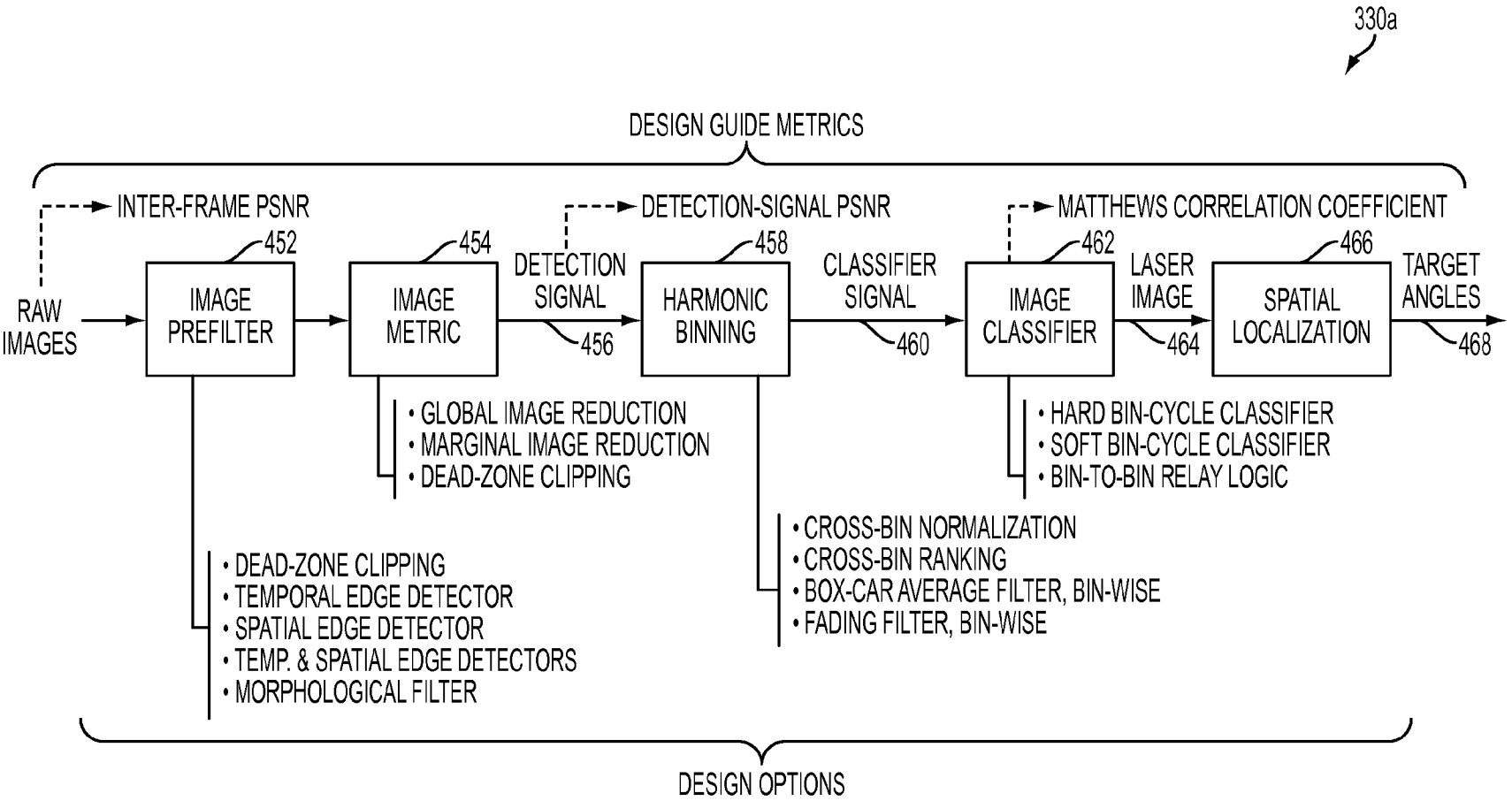
FIG. 4 is a conceptual process flow diagram illustrating a more detailed implementation of the harmonic shuttering methodology of the disclosed embodiments.
Figure 5:
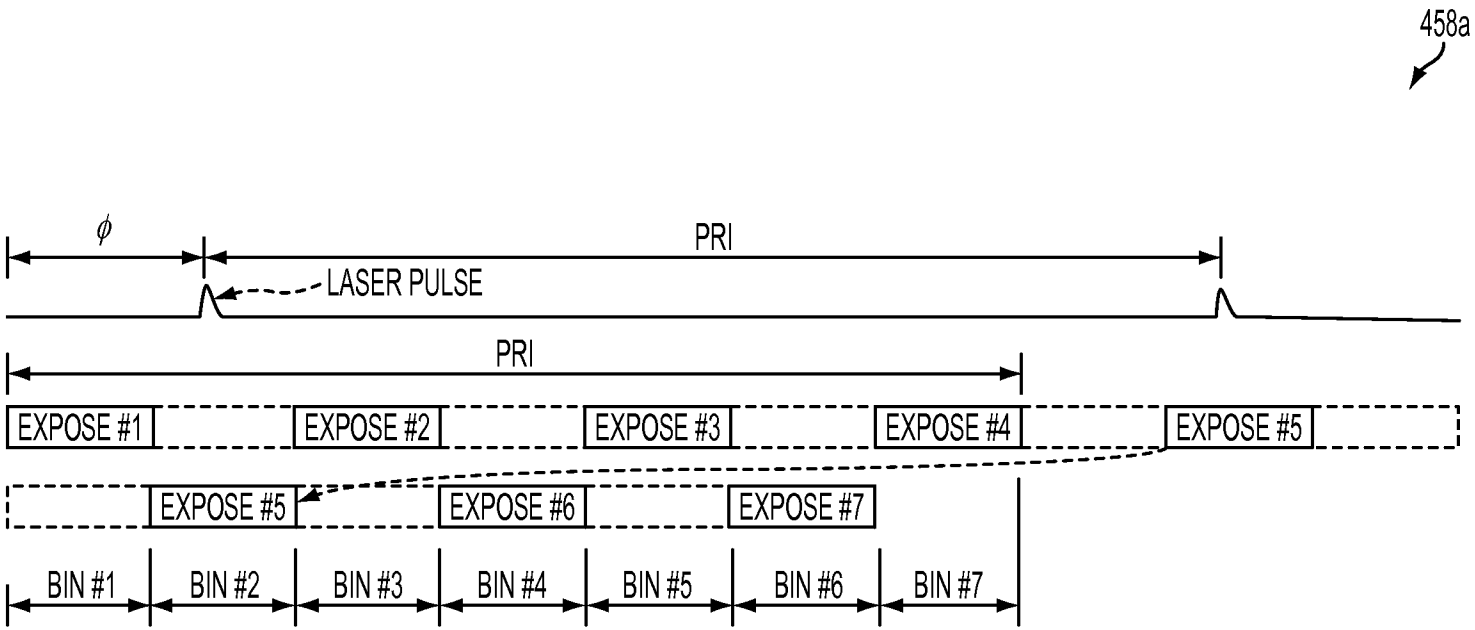
FIG. 5 illustrates an example of the harmonic binning methodology of the disclosed embodiments.
Figure 6:
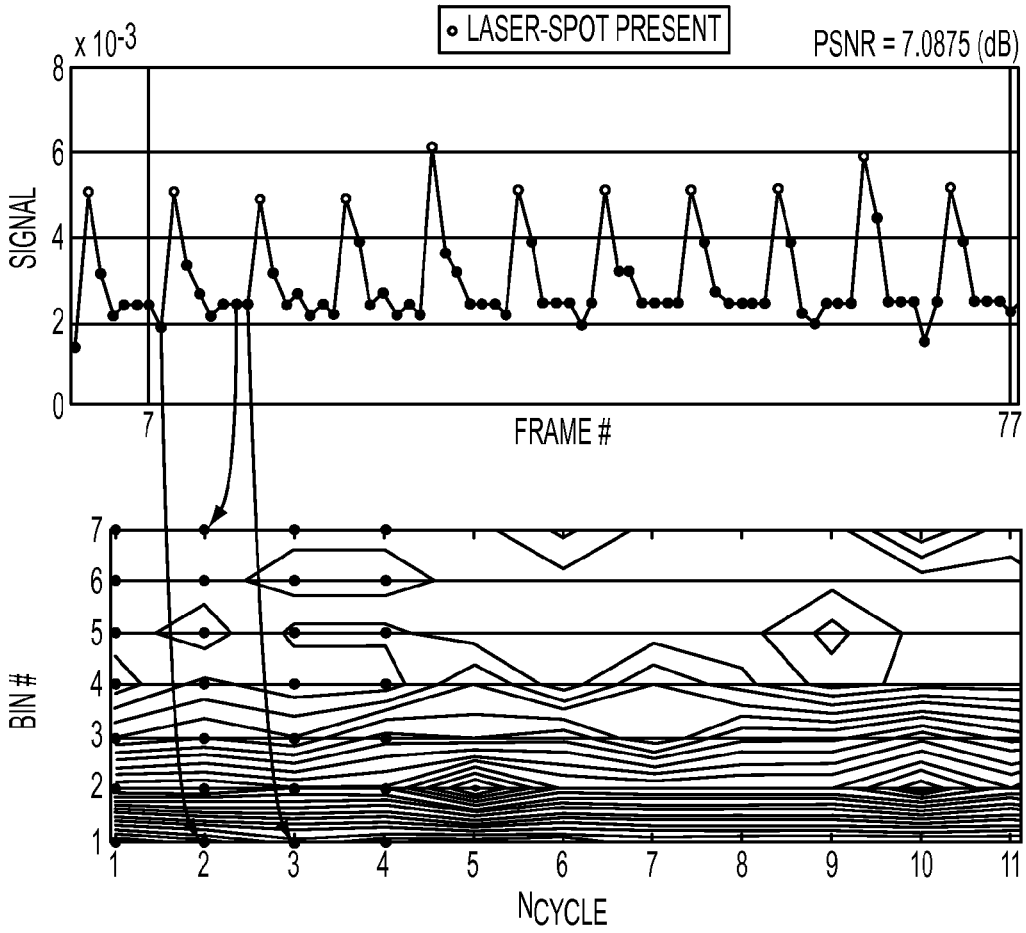
FIG. 6 is a graph illustrating an example of how the first eleven pulses can be plotted for a harmonic binning methodology of the disclosed embodiments.
Figures 7, 8:
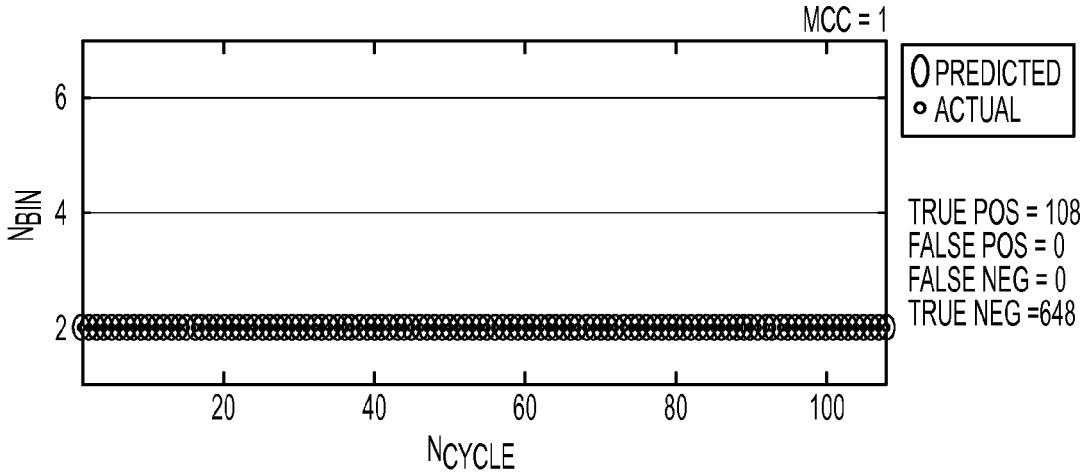
FIG. 7 shows for each binning cycle of FIG. 6, which bin contains the actual laser pulse (marked with a dot) and which bin contains the predicted laser pulse (marked with a circle) as determined by the Image Classifier.
FIG. 8 illustrates a layout for a confusion matrix showing the number of true positive (TP), false positive (FP), false negative (FN), and true negative (TN) counts of an entire video for the examples shown in FIGS. 6 and 7.

FIGS. 4-8 illustrate how the harmonic shuttering methodology 330 of FIG. 3 may be utilized to implement a cost-effective, accurate and reliable multi-mode/multi-homing mode seeker system having a laser mode and an imaging mode. FIG. 4 is a more detailed example of a multi-mode/multi-homing implementation of a harmonic shuttering methodology 330*a* of the disclosed embodiments, and FIG. 5 shows the details of a harmonic binning methodology 458*a* of the multi-homing mode harmonic shuttering methodology 330*a*. FIG. 4 is an overall conceptual process flow from raw images to target bearing angles, including various design guide metrics and various design options for implementing the multi-mode/multi-homing mode harmonic shuttering methodology 330*a*. The raw images are captured at an odd multiple of the predetermined PRF of the seeker/designator pair. For each "lased" image, the target bearing angles are determined from the location of the laser spot within the imager's FOV. FIG. 6 is a graph illustrating an example of how the first eleven binning cycles can be plotted for the multi-mode/multi-homing harmonic binning methodology 458*a* of FIG. 5. FIG. 7 shows for each binning cycle of FIG. 6, which bin contains the actual laser pulse (marked with a dot) and which bin contains the predicted laser pulse (marked with a circle). FIG. 8 illustrates a layout for a confusion matrix showing the number of true positive (TP), false positive (FP), false negative (FN), and true negative (TN) counts of an entire video for the examples shown in FIGS. 6 and 7.

Referring now to FIG. 4, the harmonic methodology 330*a* includes raw image inputs, image pre-filtering 452, an image metric stage 454, a detection signal 456, a harmonic binning stage 458, a classifier signal 460, an image classifier stage 462, a laser image 464, a spatial localization stage 466 and target angles, arranged and configured as shown. The image pre-filter 452 receives raw image inputs and uses image filtering techniques to enhance the appearance of the laser designator spot and reduce background clutter. Its goal is to improve the signal-to-noise ratio. Here, the "signal" is the laser spot and "noise" includes background clutter as well as imager noise. Ideally algorithms to implement the image pre-filter 452 should be kept to a minimum to reduce computational loading. Due to weapon ego-motion it is also desirable to delay any localized or spatial-based processing, otherwise image-to-image target feature tracking algorithms may be required, which could increase computational expense.

Continuing with FIG. 4, an image metric 454, using no a priori knowledge of the laser-spot location, creates a detection signal 456 by reducing the entire image to a signal which correlates with the presence of a lased image. Options to reduce the image to a detection signal will be discussed later in this disclosure. The detection signal 456 can be referred to as the "metric" of the image. Ideally the information content of each input image of the image metric stage 454 will be reduced to a single value. It is, however, possible to break the image into non-overlapping sub-regions in order to tile the entire field-of-view, thereby reducing each region to a separate metric. However, this approach may require separate harmonic binning stages 458 for each sub-region, and the subsequent image classifier stage 460 will become more complicated as it then needs to merge the sub-regions for the best candidate.

The harmonic binning stage 458 shown in FIG. 4 will now be described with reference to FIG. 4 and the specific examples illustrated in FIGS. 5 and 6. It should be emphasized, however, that the specific examples herein are disclosed to convey the basic ideas of the disclosed embodiments but not to limit the independent parameters in the design. For example, setting the duty cycle at 1:1 in the disclosed examples is a design choice. The disclosed embodiments may be provided with 1:N duty-cycle, but the design choice of a duty cycle other than 1:1 it would result in imager 214 (shown in FIG. 2) taking more pulses to acquire a lock than the design choice of a 1:1 duty cycle. Likewise, the harmonic number (i.e., number of sub-intervals) can be adjusted to vary the exposure times. Decreasing exposure time (i.e., raising the harmonic used) allows for fainter laser energy to be separated out of background light, but raises the required frame rate of the imager and subsequent amount of data to be processed. Thus, the 7th harmonic of the disclosed examples may or may not be used in practice but is utilized in this disclosure to convey the basic idea. In practice, the chosen harmonic would more typically be in the 43th to 93rd harmonic range. In the disclosed example, the harmonic binning stage 458 creates seven bins per cycle and sequentially places detection signals into each bin. There are seven bins due to the example video being captured at the 7th harmonic. Because the seeker has received beforehand the pulse repetition interval (PRI=1/PRF) of the laser designator, the only missing information necessary to capture an active laser pulse in the image is locking onto the subinterval (a.k.a., phase) that has the laser pulse present. In the example shown in FIG. 5, the known pulse repetition interval is divided into sevenths (i.e., using the 7th harmonic of the laser PRF). The laser pulse will randomly fall into one of these sub-intervals. The laser pulse is repeatedly captured in every fifth exposure of the shuttering sequence. By arranging the exposure sequence into bins, and reducing the filtered image of each exposure to a single detection signal (placed in their respective bins), then the bin with the highest persistent detection value will correspond to the exposure subinterval with the active laser spot. In this example the imager duty-cycle is 1:1, i.e., the exposure time is equal to the dark time.

The harmonic binning stage 458 is further illustrated by the graphs shown in FIG. 6, which show an example of the first 11 binning cycles. The bins are sorted in frame order because the video data was gathered with a 1:1 duty cycle. Because the lased images correspond to the highest detection signal values, it can be seen that the second frame of each cycle contains the laser pulse.

Referring again to FIG. 4, the image classifier stage 462, for each bin cycle, finds the bin with the maximum detection signal 456 and declares that bin's image to be the lased image. All other bin images are declared to be non-lased images. The image classifier stage 462 monitors the harmonic binning stage 458 and makes the final prediction of which image in each cycle of images (if any) contains the laser designator spot, thus determining lock. FIG. 7 is a plot showing, for each cycle, which bin contains the actual laser pulse (marked with a dot) and which bin contains the predicted laser pulse (marked with a circle). The text to the right of the plot in FIG. 7 lists the so-called "confusion" matrix values for this test, and FIG. 8 is an example matrix showing how the confusion values may be displayed. The confusion matrix values include the number of true positive (TP), false positive (FP), false negative (FN), and true negative (TN) counts of the entire video. The term "matrix" arises because this data is usually presented in tabular form as shown in FIG. 8.

Thus, referring again to FIG. 4, the detect decode, and lock stages (452, 454, 458 and 462) form a binary classifier signal 460 that identifies all raw input images as either an actively designated image or not. Those images which it determines contain an active laser spot are passed onto the spatial localization stage 466 as "laser" images 464. The spatial localization stage 464 translates the row and column index of the center of the laser spot into vertical and horizontal target bearing angles 468, respectively. Additional image processing may be applied to more specifically locate the laser spot within the field-of-view.

FIG. 4 also lists various design guide metrics that may be considered in connection with implementing the disclosed embodiments. These include, for example, considerations of the inter-frame peak signal to noise ratio (PSNR), detection-signal PSNR and the Matthews Correlation Coefficient (MCC). To quantify the difficulty of extracting the laser spot signal from the background noise, the inter-frame PSNR may be used. The inter-frame PSNR is the peak energy of the pulse divided by the mean energy of the background for a single image.

The MCC normalizes so-called "proportion of prediction" issues for the confusion values of FIGS. 7 and 8. The MCC is a value between −1 and +1. A coefficient value of +1 represents a perfect prediction, 0 represents no better than random guesses, and +1 indicates perfectly wrong prediction (i.e., total disagreement between observation and prediction). FIG. 7 shows an MCC value of +1 in the upper right-hand corner of the plot for the disclosed examples. The MCC can be computed directly from the confusion matrix elements according the following equation, $$MCC = \frac{(TP \times TN) - (FP \times FN)}{\sqrt{(TP + FP)(TP + FN)(TN + FP)(TN + FN)}}$$

FIG. 4 further lists examples of design goals for each stage, along with a list of options for each stage. Not all options are mutually exclusive. There are multiple design options for each stage in any candidate algorithm to implement the harmonic shuttering methodology of the disclosed embodiments. These options are driven by the goals of each stage in the process. Thus, for example, dead-zone clipping can be included with temporal, positive edge detection in the image pre-filter stage 452. Within each stage (452, 454, 458, 462), the options are sorted in order of expected computational loading, starting with items of expected lower processing loads and proceeding to items of expected higher processing loads. The design options listed in FIG. 4 are not exhaustive. The following paragraphs describe each design option in more detail.

Image pre-filter stage 452—the design goal of this stage is to enhance laser pulse signals and suppress background clutter & noise signals. Design options include but are not limited to (a) dead-zone clipping of image pixel values (i.e., zero any pixel value below a given threshold); (b) temporal, positive edge detection filter subtracts previous frame from current frame and zeros all negative differences; (c) spatial edge-detection filter applies a sobel or prewitt edge detector to remove regions within image which are uniformly illuminated; this can be done row-wise, column-wise or as a standard 2D spatial filter; (d) spatial & temporal, positive edge detection filter combines the previous two filters into a single operation, and because the temporal edge detection includes zeroing negative edge values, it is a non-linear function and therefore the order (spatial-temporal vs. temporal-spatial) is important, with each order giving different outputs; and (e) morphological filter looks for elliptical or circular spots, not long linear or sharp-cornered features, and literally counts the circular spots found.

Image metric stage 454—the design goal of this stage is to create a scaled detection signal that correlates with the presence of a lased image and yet minimizes image processing. Design options include but are not limited to (a) a marginal image reduction operation that reduces the image in one dimension; for example, each row of the image may be summed into single values so that one is left with a column of row-sums, whereby the new column vector can be marginally reduced to a single scalar, and one can compute marginal vectors as a sum, variance, or maximum across either rows, columns, or diagonals; this marginal vector can be reduced using a sum, variance, or maximum to obtain the scalar detection signal; (b) global image reduction reduces the entire image in one pass as a sum, variance or maximum of all pixels in the image to scalar signal; (c) dead-zone clipping of detection signal—if the proper threshold can be determined adaptively, then the noise in the PSNR can be reduced.

Harmonic binning stage 458—the design goal of this stage is to create a cross-bin peak value which correlates with lased bin and low side-lobe values (relative to peak) in non-lased bins. Design options include but are not limited to (a) cross-bin normalize/rank detection signals; because ultimately the detection signals within a pulse interval will be compared against each other and not compared to the previous binning cycles, the detection signals within each binning cycle can be scaled relative to each other, thereby allowing box-car averaging (described in the next design option) to properly weigh each binning-cycle without a momentarily bright image skewing the average; (b) box-car averaging filters, bin-wise—create a classifier input signal that averages the bin history; because confuser laser designators and momentary flashes in the seekers FOV do not typically persist in the same bin, this allows the image classifier stage 462 to ignore these events; (c) fading filters for bins—this is similar to the box-car average design option except the more recent history is given a higher weight, thereby allowing the system to more quickly respond to bin-to-bin drift of the laser pulse.

Image classifier stage 462—the design goal of this stage is to acquire and maintain lock on the correct bin (i.e., subinterval frame) and follow bin-to-bin drift. Design options include but are not limited to (a) hard bin-cycle classification, which assumes one bin will always contain a predetermined laser-pulse and others will not; (b) soft bin-cycle classification allows for delayed classification decision, i.e. it allows an "I don't know" option as well as yes/no decisions, thereby providing a failsafe in the event that no laser designator is in operation; one mechanism for this kind of logic would be to monitor the peak to side-lobe (PSL) ratio of the bins, and, when the PSL reaches a predetermined lock threshold, the classification decision can be made; until that time, the "I don't know" option holds; and (c) implementing bin-to-bin relay logic could limit the "bin of choice" from chattering between two bins with relatively equal detection signals.

Accordingly, it can be seen from the foregoing disclosure and the accompanying illustrations that one or more embodiments may provide some advantages. For example, the disclosed harmonic shuttering methodology addresses the speed and accuracy of pulse acquisition of a seeker system by significantly improving the likelihood that the seeker's predetermined PRF will be detected and not missed, and further increases the likelihood that the seeker's PRF can be detected and locked within no more than two pulse intervals using a only a 50:50 duty cycle. Using the disclosed embodiments, performance improvements are achieved but not at the cost of increased cost and complexity. On the contrary, the harmonic shuttering methodology of the disclosed embodiments potentially decreases cost by allowing relatively simple and relatively low cost components (e.g., a single conventional FPA of a low frame-rate, SWIR camera).

Those of skill in the relevant arts will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill in the relevant arts will also appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosed embodiments.

Finally, the methods, sequences and/or algorithms described in connection with the embodiments disclosed herein may be embodied directly in hardware, i.e., ROIC or Controller, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor or ROIC. Accordingly, the disclosed embodiments can include a computer readable media embodying a method for performing the disclosed and claimed embodiments. Accordingly, the invention is not limited to illustrated examples and any means for performing the functionality described herein are included in the disclosed embodiments. Furthermore, although elements of the disclosed embodiments may be described or claimed in the singular, the plural is contemplated unless limitation to the singular is explicitly stated. Additionally, while various embodiments have been described, it is to be understood that aspects of the embodiments may include only some aspects of the described embodiments. Accordingly, the disclosed embodiments are not to be seen as limited by the foregoing description, but are only limited by the scope of the appended claims.

What is claimed is:

1. A method of detecting and decoding locking pulses having a predetermined PRF, the method comprising:

dividing, by a controller, a pulse interval of the predetermined PRF into a plurality of repeating subintervals;

exposing, by an imager, alternating ones of said plurality of repeating subintervals;

determining, by said controller, whether two or more received pulses are received in one of said subintervals by said exposing; and identifying, by said controller, said one of said subintervals of said pulse interval, thereby detecting and decoding said received pulses of said one of said subintervals as having the predetermined PRF.

2. The method of claim 1 further comprising:

adjusting said exposing to expose on said one of said subintervals instead of said alternating ones of said plurality of repeating subintervals, thereby locking on to a PRF pattern of said received pulses of said one of said subintervals as having the predetermined PRF.

3. The method of claim 2 further comprising capturing, by said imager, said received pulses of said one of said subintervals.

4. The method of claim 3 further comprising using, by said controller, said received pulses of said one of said subintervals to derive control information that is used to steer an ordnance to a target.

5. The method of claim 2 further comprising evaluating, by said controller, others of said subintervals to determine if a lack of pulses is present in said others of said subintervals.

6. The method of claim 5 further comprising not locking, by said controller, said received pulses if a predetermined number of said received pulses are present in said others of said subintervals.

7. The method of claim 1 wherein said plurality of subintervals comprises an odd multiple of the predetermined PRF.

8. The method of claim 7 wherein said subintervals comprise substantially equal lengths.

9. The method of claim 1 further comprising:

capturing, by said imager, an image and locating a laser spot of said received pulse of said one of said subintervals on said image.

10. The method of claim 9 further comprising using, by said controller, said received pulse of said one of said subintervals and said image to derive control information that is used to steer an ordnance to a target.

11. An imager for detecting and decoding image data and laser data having a predetermined PRF, the imager comprising:

a focal plane array; and the imager configured to:

control said focal plane array to decode the image data and the laser data;

divide a pulse interval of the predetermined PRF into a plurality of subintervals;

expose alternating ones of said plurality of subintervals;

determine whether two or more received pulses are received in one of said subintervals; and identify said one of said subintervals of said pulse interval, thereby detecting and decoding said received pulses of said one of said subintervals as having the predetermined PRF.

12. The imager of claim 11 wherein the imager is further configured to:

adjust said exposing to lock on said one of said subintervals instead of exposing said alternating ones of said plurality of subintervals, thereby locking on to a PRF of said received pulses of said one of said subintervals as having the predetermined PRF.

13. The imager of claim 12 wherein the imager is further configured to capture said received pulses of said one of said subintervals.

14. The imager of claim 13 wherein the imager is further configured to use said received pulses of said one of said subintervals to derive control information that is used to steer an ordnance to a target.

15. The imager of claim 12 wherein the imager is further configured to evaluate others of said subintervals to determine whether said received a pulse is present in said others of said subintervals.

16. The imager of claim 15 wherein the imager is further configured to not capture said received pulses if a predetermined number of said pulses are present in said others of said subintervals.

17. The imager of claim 11 wherein said plurality of subintervals comprises an odd multiple of the predetermined PRF.

18. The imager of claim 17 wherein said subintervals comprise substantially equal lengths.

19. The imager of 11 wherein the imager is further configured to locate a laser spot of said received pulses of said one of said subintervals on said image.

20. The imager of claim 19 wherein the imager is further configured to use said received pulses of said one of said subintervals and said image to derive control information that is used to steer an ordnance to a target.

* * * * *